US005553631A

United States Patent [19]

Schach

[11] Patent Number: 5,553,631

[45] Date of Patent: Sep. 10, 1996

[54] HAIR STYLING DEVICE

[76] Inventor: Bernadine Schach, 905 Rainbow Dr., Richardson, Tex. 75081

[21] Appl. No.: 423,823

[22] Filed: Apr. 19, 1995

[51] Int. Cl.[6] ..... A45D 7/00

[52] U.S. Cl. ..... 132/210; 132/273; 132/246; 132/247; 132/253

[58] Field of Search ..... 132/210, 246, 132/253, 219, 222, 273, 247

[56] References Cited

U.S. PATENT DOCUMENTS

| | | | |
|---|---|---|---|
| 1,241,337 | 9/1917 | Breitenstein | 132/273 |
| 1,437,440 | 12/1922 | Pentecost | 132/273 |
| 1,523,962 | 1/1925 | Hitzigrath | 132/246 |
| 5,303,723 | 4/1994 | Schach . | |

*Primary Examiner*—Gene Mancene
*Assistant Examiner*—Pedro Philogene
*Attorney, Agent, or Firm*—John L. Sigalos

[57] ABSTRACT

A hair styling device comprising an elongated shaped outer covering, a deformable elongated structure within the interior of said device capable of being repeatedly bent to form said device into a variety of shapes, and an essentially centrally located elongated opening within the material to expose a central region of the deformable elongated structure, the essentially centrally located elongated opening being adapted for partial withdrawal of the central portion of the deformable structure to permit hair to be passed through a region lying between the withdrawn portion of the deformable structure and the elongated opening.

15 Claims, 1 Drawing Sheet

HAIR STYLING DEVICE

BACKGROUND OF THE INVENTION

This invention relates to hair styling accessories and more particularly to such accessories adapted for shaping long hair into a variety of styles, while minimizing or eliminating the requirement for pins or other clamping devices.

As is known to those skilled in the art, the styling of women's hair has found expression in many and varied forms. Basic styles change from time to time and, in addition, within basic styles the specific expression of such styles may be significantly different from person to person so as to emphasize and/or complement individual facial qualities of each person.

Customizing hair styles to optimally complement differing facial features has challenged stylists and has often required the use of complicated and time-consuming techniques. Moreover, implementing certain styles has required employment of a stylist and has been expensive.

It has been found that the use of certain devices has greatly simplified the styling of hair. Thus, for example, in U.S. Pat. No. 5,303,723 granted to Denie Schach on Apr. 19, 1994, the disclosure of which is herein incorporated by reference, there is disclosed an auxiliary styling device which greatly simplifies the styling of hair into desired shapes such as buns, ponytails, French knots, and other shapes. However, effective as such heretofore known auxiliary styling devices have been, there has continued to be a need for devices exhibiting still greater versatility.

BRIEF SUMMARY OF THE INVENTION

The improved hair styling auxiliary device according to the invention comprises an elongated shaped outer covering, a deformable elongated structure of predetermined length within the interior of the device capable of being repeatedly bent to form the device into a variety of shapes, and an essentially centrally located elongated opening within the outer covering and along one side thereof to expose a central region of the deformable elongated structure, the essentially centrally located elongated opening being adapted for partial withdrawal of the central portion of the deformable structure to permit hair to be passed through a region lying between the withdrawn portion of the deformable structure and the elongated opening. Thus, additional versatility is imparted to the device. The deformable structure may then be bent into a desired shape to hold hair between an inner surface of the deformable structure and an adjacent outer surface of the material and, thus, more effectively shape the hair in a variety of patterns and forms.

OBJECTS AND FEATURES OF THE INVENTION

It is one general object of the invention to improve hair styling accessories.

It is another object of the invention to improve versatility in a hair styling accessory.

It is still another object of the invention to facilitate use of a hair styling accessory without the requirement for pins or other clamping devices.

Accordingly, in accordance with one feature of the invention, there is provided within an elongated sleeve a deformable elongated structure and an elongated aperture within the elongated sleeve through which a central portion of the deformable elongated structure may be partially withdrawn, thereby increasing versatility of use of the composite structure of the sleeve and elongated structure.

In accordance with another feature of the invention, provision is made for passing hair through the space formed when the aforementioned central portion is partially withdrawn, thus providing a way to capture hair for manipulation.

In accordance with still another feature of the invention, provision is made for urging the aforementioned central portion back toward the elongated aperture, thus providing a way to lock the captured hair for further manipulation and/or shaping.

These and other objects and features of the invention will be apparent from the following description by way of example of a preferred embodiment, with reference to the drawing.

DESCRIPTION OF A PREFERRED EMBODIMENT

Figure 1:
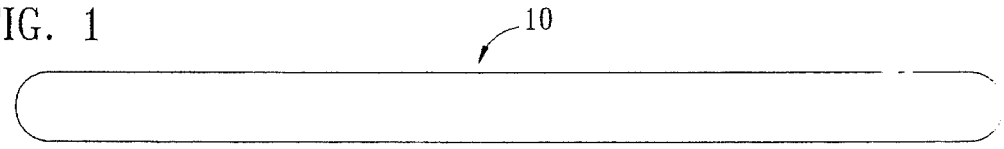
FIG. 1 is a side view of a deformable rod adapted for use with the present invention.

Now turning to the drawing, and more particularly FIG. 1, it will be seen that there is depicted a deformable means 10, a rod, adapted for use with the present invention. As described in the above-identified U.S. patent, such means may be any flexible rod, bar, or the like, made of copper, aluminum, and the like which can be repeatedly bent without fracturing. Such rod may take any of a variety of geometrical configurations and may, for example, be circular, oval, or modified rectangular in cross section. It may be coated with a protective layer of material such as TEFLON or the like, or it may be left bare.

Figure 2:
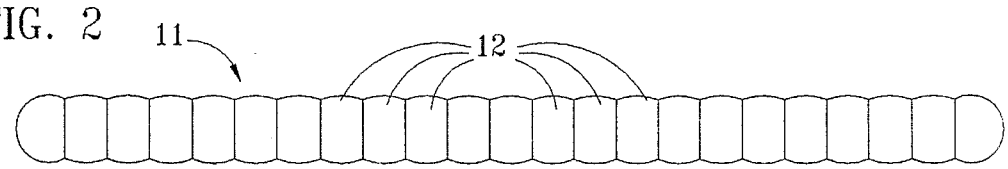
FIG. 2 is a side view of a segmented deformable rod adapted for use with the present invention.

In FIG. 2 there is depicted another form of structure that may be useful in practicing the principles of the present invention. A segmented elongated structure 11 is provided in which segments 12 are interlocking. A well known example of such a segmented elongated structure is that which is employed in goose-necked lamps and the like. An advantage deriving from use of the structure of FIG. 2 is that the bending of such a structure ordinarily would impart less fatigue to the material and consequently the structure would be expected to withstand more usage without failure. Another advantage is that such segments may be made of plastic materials which are inexpensive and generally lighter in weight. As with the structure of FIG. 1, the structure of FIG. 2 may also be coated with a protecting layer of material such as TEFLON or the like, or it may be left bare.

Figure 3:
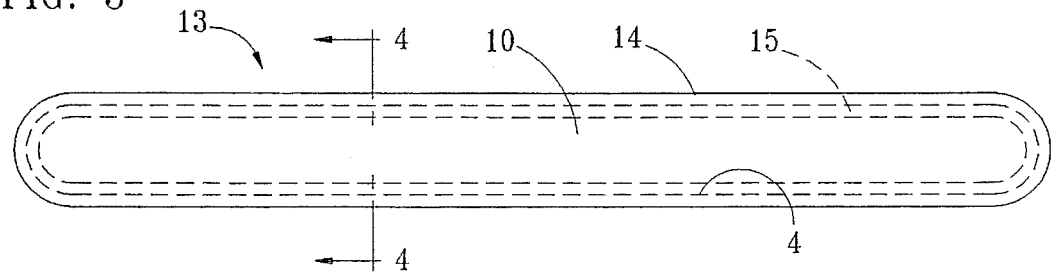
FIG. 3 is a side view of the rod of FIGS. 1 or 2 covered with a sleeve.

In order to provide surfaces that are particularly adapted for engagement with human hair, a special sleeve assembly preferably is fitted over the structure of FIG. 1 or FIG. 2 to form a composite structure 13. An illustration of such is depicted in FIG. 3 in which outer sleeve covering 14 is shown encasing the rod 10 (or 11). Such outer sleeve is made of material capable of clinging to hair, most suitably any polyurethane ester foam. Between the outer surface of rod 10 (or 11), and the inner surface 14*a* of sleeve 14 is shown film layer 15 loosely fitted about rod 10. This film layer 15 is preferably stitch witchery, although other plastic material can be used.

Figure 4:
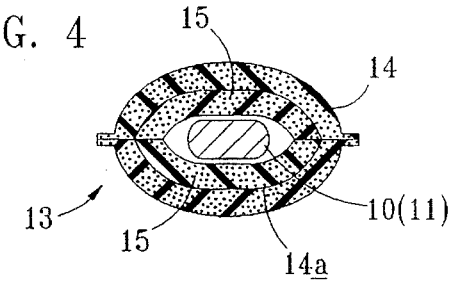
FIG. 4 is a section view of FIG. 3 taken along the section lines 4—4.

Reference to FIG. 4 depicts the interior of the composite of FIG. 3 in more detail. There, in FIG. 4, is seen the outer sleeve 14 and film layer 15 encasing rod 10 (or 11).

It will be evident that the outer sleeve 14 and film layer 15 assembly is depicted as an elongated rod. It can have the peanut shape described in the above-identified United States patent.

Figure 5:
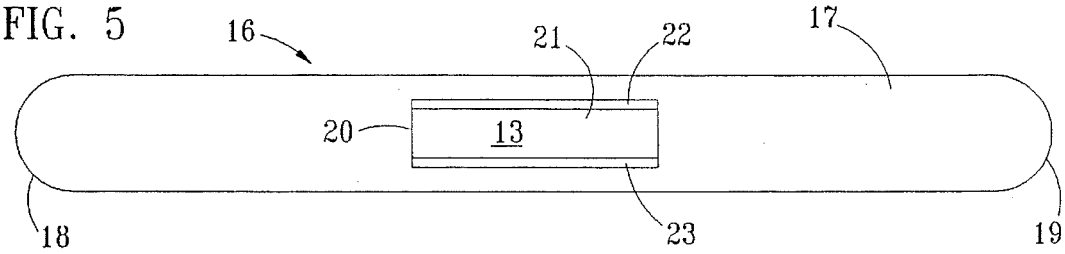
FIG. 5 is a side view of the hair styling device according to the invention.

Now turning to FIG. 5, a completed structure 16 according to the invention hereof is depicted. There, in FIG. 5, is illustrated the composite deformable structure 13 of FIGS. 3 and 4 fitted loosely within an exterior covering 17 which is made of any textile material (such as cloth) whether of cotton, wool, synthetic, or blend thereof. Along the side of the completed structure 16 and located approximately midway between the ends 18 and 19 thereof, is an opening 20 which preferably (but not necessarily) is generally rectangular in geometry and preferably, but not necessarily, extends about one third of the distance between ends 18 and 19. Such opening is greater in width than height, the preferred dimensions thereof being approximately from one-and-one-half to two inches in width; and the height varying from about zero to one-half inch, depending upon the characteristics of the material of covering 17. Although opening 20 is depicted as a rectangle, it should be evident to those skilled in the art that it could be an elongated slit provided that the material is sufficiently resilient and that the slit would be of sufficient length to permit the ready withdrawal of the desired central portion of composite deformable structure 13 as is described below. It will also be evident that opening 20 could readily be made in an oval geometry or the like if desired.

Shown as being exposed to the exterior through opening 20 is the central portion 21 of deformable structure 13. To illustrate the preferably loose fit of structure 13 within covering 17, there are shown surrounding spaces 22 and 23. Opening 20 is preferably over central portion 21 of structure 13, although it can be offset therefrom if desired.

Figure 6:
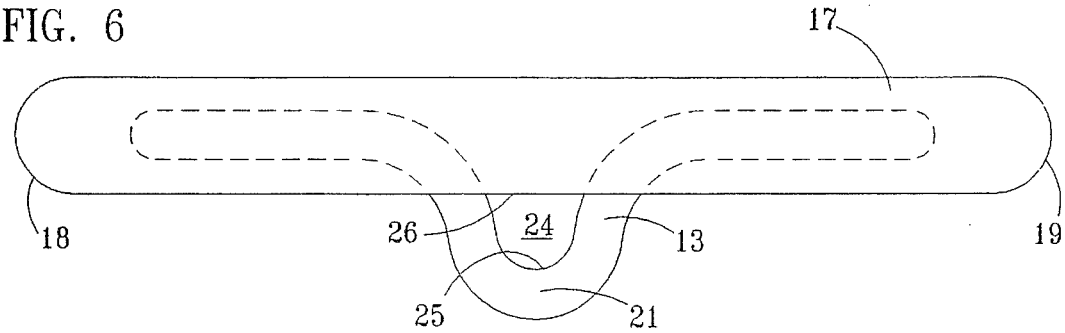
FIG. 6 is a top view of the hair styling device according to the invention.

Now turning to FIG. 6 (which, it will be recalled is a top view of the hair styling device according to the invention), the composite deformable structure 13 is shown as being bent and the central part 21 thereof partially withdrawn to the exterior from within the interior of covering 17 so as to form a space 24 between a surface 25 of structure 13 and a juxtaposed surface 26 of covering 17. Space 24 can readily be varied in size by manual manipulation as, for example, by varying the degree to which structure 13 is bent and by varying the extent to which its central portion 21 is withdrawn to the exterior. Accordingly, provision is made to accommodate hair tresses of varying thicknesses that may be passed therethrough and held within.

Figure 7:
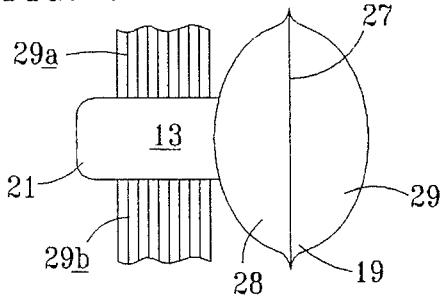
FIG. 7 is an end view of the device of FIG. 6 and including a lock of hair retained in position for manipulation and styling.

As mentioned above, FIG. 7 is an end view of the device of FIG. 6 and including a lock of hair in position for manipulation and styling. There, in FIG. 7, are seen the end 19, a seam 27 joining the front and rear halves 28 and 29 of covering 17, central part 21 of deformable structure 13, and parts 29*a* and 29*b* of a lock of hair passing through space 24 (FIG. 6). As previously mentioned, since structure 13 is so readily deformable, it is easy to withdraw the central portion 21 to form a larger than needed space 24 to facilitate passage of hair therethrough; and thereafter to urge portion 21 inwardly toward covering 17 to frictionally engage the lock of hair therewith and hold it in position within the then smaller area of region 24. The lock of hair, thus held is readily manipulable for fashioning into a desired shape and style. This can comprise any of a variety of manipulations including: (1) the rotation of the device about its central axis to wind hair thereupon; (2) the bending of the extremities 18 and 19 forwardly or rearwardly toward the center so as either to capture or not capture additional strands of hair; or (3) a combination of the foregoing.

The deformable means 10 is snugly contained in the interior structure 13 such that when it is bent into various shapes it will thereby bend the device 13 into such various shapes and when bent back to its original linear shape the device 13 will assume its original linear shape.

With respect to forming device 13, the polyurethane ester foam layers 14 are first cut to the desired shape as are film layers 15. Deformable means 10 or 11 are placed between film layers 15 and then outer layers 14 are placed over film layers 15 to form an assembly of all the three elements. Film layers 15 have radio frequency waves applied to the entire periphery and fuse it to itself and to the outer layers 14 to form a unitary device 13 with the deformable means 10 encased in the interior thereof.

It is not necessary that the layers be bonded together using heat in order to melt the film layer since conventional adhesives or sewing can be utilized for this purpose.

After structure 13 is formed, it can be placed into outer covering 17 which has been sewn or otherwise fastened into a closed tube through opening 28. Alternatively, structure 13 can be placed into covering 17 before it is completely closed and then covering 17 closed.

It will now be evident that there has been described herein an improved hair styling accessory that provides increased versatility and attractiveness.

Although the inventions hereof have been described by way of a preferred embodiment, it will be evident that other adaptations and modifications may be employed without departing from the spirit and scope thereof. Thus, for example, yet a different type of central deformable member could be employed.

The terms and expressions employed herein have been used as terms of description and not of limitation; and, thus, there is no intent of excluding equivalents, but on the contrary it is intended to cover any and all equivalents that may be employed without departing from the spirit and scope of the invention.

What is claimed is:

1. An improved hair styling device comprising an elongated deformable structure capable of being repeatedly bent to form said device into a variety of shapes, an outer covering loosely enclosing said elongated deformable structure to permit movement of said structure with respect to said outer covering, said outer covering including a central opening exposing a central portion of said structure and permitting partial withdrawal of said central portion to the exterior of said outer covering while covering the remainder of said deformable structure.

2. An improved hair styling device according to claim 1 wherein said elongated deformable structure is characterized by having an elongated axis central to said structure.

3. An improved hair styling device according to claim 1 in which said elongated deformable structure comprises a bendable rod.

4. An improved hair styling device according to claim 1 in which said elongated deformable structure comprises a bendable segmented composite structure having interlocking segments.

5. An improved hair styling device according to claim 1 wherein said outer covering comprises a single layer of material.

6. An improved hair styling device according to claim 1 in which said deformable structure comprises a bendable rod having a covering of resilient material on said bendable rod.

7. An improved hair styling device according to claim 6 in which said covering comprises two sections of differing characteristics.

8. An improved hair styling device according to claim 2 wherein said central opening is elongated.

9. An improved hair styling device according to claim 2 wherein said central opening is essentially rectangular.

10. An improved hair styling device according to claim 8 wherein the elongation of said central opening is essentially parallel to said elongated axis of said structure.

11. An improved hair styling device according to claim 8 wherein said elongated deformable structure has a predetermined elongated length and wherein the elongation of said central opening is about one-third of said predetermined elongated length.

12. An improved hair styling device according to claim 9 wherein the elongation of said central opening is essentially parallel to said elongated axis of said structure.

13. A method of hair styling employing an auxiliary device having an elongated deformable structure capable of being repeatedly bent to form said device into a variety of shapes, an outer covering of material loosely enclosing said elongated deformable structure to permit movement of said structure with respect to said material, said outer covering including an opening exposing a portion of said structure and permitting partial withdrawal of said portion to the exterior of said material while covering the remainder of said deformable structure, said method comprising steps of:

(a) bending said deformable structure to draw a portion of said structure through said opening to form a space between said portion and said outer covering;

(b) passing a lock of hair to be styled through said space; and (c) pressing said portion of said deformable structure toward said outer covering to tighten said central portion against said lock of hair.

14. The method of hair styling according to claim 13 further including a step of bending an end of said deformable structure.

15. The method of hair styling according to claim 14 further including a step of bending two ends of said deformable structure.

* * * * *